US009650881B2

(12) United States Patent
Clem

(10) Patent No.: US 9,650,881 B2
(45) Date of Patent: May 16, 2017

(54) REAL TIME TOOL EROSION PREDICTION MONITORING

(71) Applicant: Nicholas J. Clem, Houston, TX (US)

(72) Inventor: Nicholas J. Clem, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 429 days.

(21) Appl. No.: 14/271,692

(22) Filed: May 7, 2014

(65) Prior Publication Data

US 2015/0322765 A1 Nov. 12, 2015

(51) Int. Cl.

| | |
|---|---|
| ***E21B 47/00*** | (2012.01) |
| ***E21B 12/02*** | (2006.01) |
| ***E21B 43/04*** | (2006.01) |

(52) U.S. Cl.

CPC ..... *E21B 47/0007* (2013.01); *E21B 12/02* (2013.01); *E21B 43/04* (2013.01); *E21B 47/0008* (2013.01)

(58) Field of Classification Search

CPC ... E21B 47/0007; E21B 43/04; E21B 47/0008
See application file for complete search history.

(56) References Cited

U.S. PATENT DOCUMENTS 5,210,704 A * 5/1993 Husseiny ..... G01H 1/003 702/34
5,406,502 A * 4/1995 Haramaty ..... G05B 19/4063 702/183
5,608,845 A * 3/1997 Ohtsuka ..... G07C 3/00 702/34
6,226,597 B1 * 5/2001 Eastman ..... G06Q 10/06 702/34
6,260,004 B1 * 7/2001 Hays ..... G05B 23/0235 702/130
6,401,056 B1 * 6/2002 Sirois ..... G21C 17/00 702/183
6,704,689 B1 * 3/2004 Hogan ..... G06Q 10/06 702/182
6,898,551 B2 * 5/2005 Samata ..... G01H 1/003 702/182
7,457,785 B1 * 11/2008 Greitzer ..... G01D 1/18 706/12

(Continued)

OTHER PUBLICATIONS

PCT International Search Report and Written Opinion; International Application No. PCT/US2015/022405; International Filing Date: Mar. 25, 2015; Date of Mailing: Jun. 22, 2015; pp. 1-13.

*Primary Examiner* — Blake Michener
(74) *Attorney, Agent, or Firm* — Cantor Colburn LLP

(57) ABSTRACT

A method, system and computer-readable medium for estimating a life expectancy of a tool used in a pumping operation is disclosed. A property of the tool is obtained and a pumping parameter of the downhole operation is selected. The pumping parameter is related to erosion of the tool. A value of the pumping parameter is measured during the pumping operation. The life expectancy of the tool is estimated during the pumping operation using the obtained property of the downhole tool and the measured value of the pumping parameter. The value of the pumping parameter may then be changed to a new value in order to affect the life expectancy.

18 Claims, 3 Drawing Sheets

(56) References Cited

U.S. PATENT DOCUMENTS

| | | | | |
|---|---|---|---|---|
| 8,988,236 | B2 * | 3/2015 | Liu | E21B 47/0008 340/679 |
| 8,988,237 | B2 * | 3/2015 | Liu | E21B 47/0007 340/679 |
| 9,157,308 | B2 * | 10/2015 | Balogun | E21B 43/121 |
| 9,280,517 | B2 * | 3/2016 | Liu | G06F 17/10 |
| 9,297,245 | B2 * | 3/2016 | Stephenson | E21B 41/0092 |
| 9,324,049 | B2 * | 4/2016 | Thomeer | G06Q 10/06316 |
| 9,422,793 | B2 * | 8/2016 | Gomes | E21B 43/08 |
| 2003/0009311 | A1 | 1/2003 | Ushiku et al. | |
| 2008/0262736 | A1 | 10/2008 | Thigpen et al. | |
| 2009/0041588 | A1 * | 2/2009 | Hunter | F04B 7/0076 417/27 |
| 2011/0011581 | A1 | 1/2011 | Stephenson et al. | |
| 2011/0255992 | A1 * | 10/2011 | Tran | F04B 49/065 417/1 |
| 2012/0016589 | A1 * | 1/2012 | Li | E21B 47/0006 702/9 |
| 2012/0310553 | A1 | 12/2012 | Ong | |

* cited by examiner

REAL TIME TOOL EROSION PREDICTION MONITORING

BACKGROUND OF THE DISCLOSURE

1. Field of the Disclosure

The present disclosure is related to a method of determining an erosion rate of a tool used in downhole applications and, in particular, to determining a life time of a tool using in-situ measurements of pumping parameters.

2. Description of the Related Art

Various downhole processes, such as stimulation or fracturing ("fracking") processes for example, pump erosive fluids and other materials from a surface location to a subterranean formation in order to break up the subterranean formations, thereby causing the release of hydrocarbons. The tools that deliver these erosive materials are also in contact with the erosive fluid and therefore are susceptible to their erosive effects. Such downhole tools thus have an expected lifetime or wear rate that is determined, in part, by their level of exposure to and interaction with the erosive fluids. Therefore, when performing downhole processes, it is desirable to know how long one may be able to use the downhole tools before erosion renders the downhole tool sufficiently useless for its purposes in order that the tools may be replaced on a timely schedule.

SUMMARY OF THE DISCLOSURE

According to one aspect, the present disclosure provides a method of estimating a life expectancy of a tool used in a pumping operation, the method including: obtaining a property of the tool; selecting a pumping parameter of the downhole operation, wherein the pumping parameter is related to erosion of the tool; measuring a value of the pumping parameter during the pumping operation; and estimating, during the pumping operation, the life expectancy of the tool using the obtained property the downhole tool and the measured value of the pumping parameter.

According to another aspect, the present disclosure provides a system for estimating a life expectancy of a tool in a pumping operation, the system including: a sensor configured to measure, during the pumping operation, a value of a pumping parameter related to erosion of the tool; and a processor configured to: obtain a property of the tool, and estimate, during the pumping operation, a life expectancy of the tool using the obtained property the tool and the measured value of the pumping parameter.

According to yet another aspect, the present disclosure provides a non-transitory computer-readable medium including a set of instructions stored thereon that when accessed by a processor enable the processor to perform a method of estimating a life expectancy of a tool used in a pumping operation, wherein the method includes: obtaining a property of the tool; selecting a pumping parameter of the pumping operation related to erosion of the tool; measuring a value of the pumping parameter during the pumping operation; and estimating, during the pumping operation, the life expectancy of the tool using the obtained property the tool and the measured value of the pumping parameter.

Examples of certain features of the apparatus and method disclosed herein are summarized rather broadly in order that the detailed description thereof that follows may be better understood. There are, of course, additional features of the apparatus and method disclosed hereinafter that will form the subject of the claims.

BRIEF DESCRIPTION OF THE DRAWINGS

For detailed understanding of the present disclosure, references should be made to the following detailed description, taken in conjunction with the accompanying drawings, in which like elements have been given like numerals and wherein.

DETAILED DESCRIPTION OF THE DISCLOSURE

Figure 1:
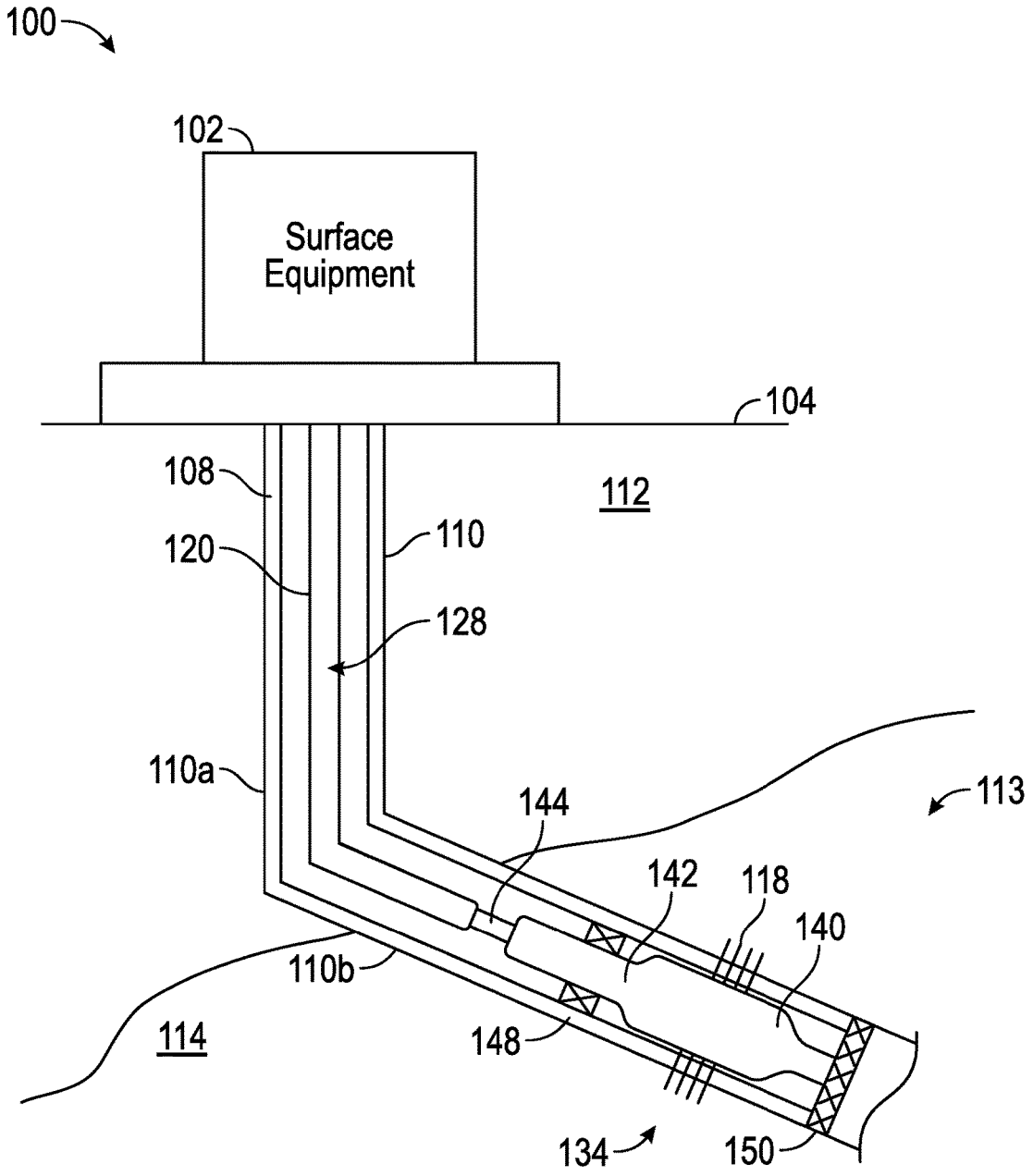
FIG. 1 shows an exemplary completion system suitable for delivery of a fluid from a surface location to a reservoir downhole according to one embodiment of the present disclosure.

FIG. 1 shows an exemplary completion system 100 suitable for delivery of a fluid from a surface location 104 to a reservoir 114 downhole according to one embodiment of the present disclosure. The exemplary system 100 includes a tool string 120 extending downward from the surface location 104 into a wellbore 110 formed in an earth formation 112. In various embodiments, the tool string 120 may be a wired pipe and/or a drill pipe that is configured to convey various tool downhole for performing a completion operation. At the surface location 104, the tool string 120 is coupled to surface equipment 102. The surface equipment 102 may be suitable for performing various completion operations such as fracturing operations ("fracking"), gravel packing operations, acid stimulation operations, sand control operations, pumping a fluid into the formation, and pumping a proppant into a formation, among others. In an exemplary embodiment, the completion system 100 pumps a fracturing fluid ("frac fluid"), proppant, sand, acid, etc. from the surface location 104 to a downhole location. The surface equipment may further provide systems for control of the downhole equipment and for determining a life expectancy of downhole equipment, in various embodiments. While the exemplary completion system 100 is shown with respect to land-based completions, this is not meant as a limitation of the present disclosure. The methods and systems disclosed herein are equally suitable for ocean rig platforms, etc.

The exemplary wellbore 110 extends through the earth formation 112 and into a reservoir 114 having a production zone 113. While only one production zone 113 is shown for illustrative purposes, any number of productions zones may be formed as the wellbore 110 extends further into the reservoir 114. The exemplary wellbore 110 includes a vertical section 110*a* and a substantially deviated section 110*b*. In various embodiments, the substantially deviated section 110*b* may be a horizontal well. The wellbore 110 is lined with a casing 108. A number of perforations 118 are created in the casing at the production zone 113 in order to create a passage for flow of hydrocarbons from the formation as well as to provide a passage for fluids to be pumped into the production zone 113. The tool string 120 is shown to include a portion that extends along the deviated section 110*b* of the wellbore 110. An exemplary downhole tool, such as fracture tool assembly 134 ("frac assembly") is conveyed along the tool string 120 to the production zone 113 to substantially coincide with the axial location of the perforations 118. The exemplary frac assembly 134 may include a screen 140. The frac assembly may further include a service tool 142 for controlling various operations of the frac assembly 134. A sensor sub 144 for measuring downhole parameters associated with the completion operation may be arranged between a top end of the service tool 142 and to a downhole end of the tool string 120. The tool string 120 defines an internal axial flowbore 128 along its length. During pumping operations, various fluids and/or solids, such as fracturing fluid and/or proppant are sent downhole through the axial flowbore 128 and into the production zone 113 of the reservoir 114 via the frac assembly 134 and perforations 118. A proppant may be naturally occurring sand grains or man-made proppants such as resin-coated sand or high-strength ceramic materials like sintered bauxite.

In an exemplary embodiment, the frac assembly 134 may be isolated within the wellbore 110 by a pair of packer devices 148 and 150. Sump packer 150 isolates a lower portion of the tool string 120 at an end of the tool string 120. Although only one frac assembly 134 is shown along the tool string 120, multiple frac assemblies may be arranged along the tool string 120 when the wellbore includes multiple production zones. The one or more frac assemblies can be located in the vertical section 110*a*, deviated section 110*b* or both the vertical section 110*a* and the deviated section 110*b*.

Figure 2:
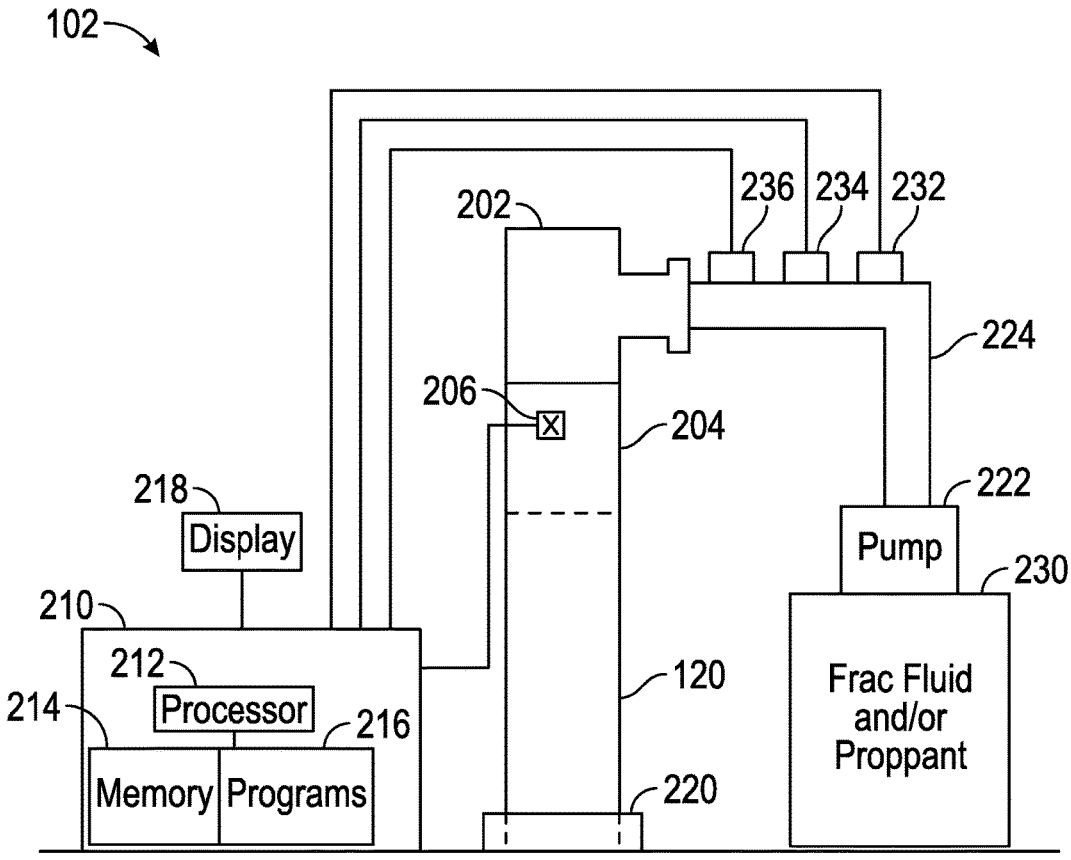
FIG. 2 shows a detailed view of surface equipment of the exemplary completion system of FIG. 1.

FIG. 2 shows a detailed view of the surface equipment 102 of the exemplary completion system 100 of FIG. 1. A top end of tool string 120 is shown. A force application device 220 is coupled to the top end of the tool string 120 and may be used to apply a downward (or upward) force on the tool string 120, for example, during a pumping process. The top end of the tool string 120 further includes an interface sub 204 and a head 202 known as a "frac head." The frac head 202 is configured for delivery of fracturing fluid and various proppants downhole.

A fluid mixture source 230 provides a fluid mixture to the frac head 202. The fluid mixture may include frac fluid and/or proppant in various ratios, compositions, etc. Pump 222 is coupled to the source 230 and pumps the fluid mixture via the conduit 224 into the frac head 202. From the frac head 202, the fluid mixture is delivered via tool string 120 to the production zone 113. The frac fluid of the fluid mixture may contain various chemicals that are corrosive and/or erosive to the equipment, including the tool string 120, the frac assembly 134 and any other downhole tools that come into contact with the frac fluid during the completion operation or pumping operation. The rate of erosion of the downhole tools may be related to various parameters such as the type of chemical, the flow rate of the fluid mixture, the viscosity of the fluid mixture, etc. Additionally, the proppant may cause erosion of the downhole equipment. The rate of the erosion may be related to various parameters of the proppant, such as the proppant type, the size of the proppant, the proppant density or proppant concentration in the fluid mixture, etc. Such parameters of the frac fluid and of the proppant that affect the erosion of the downhole tools are referred to herein as "pumping parameters." It is also noted that the erosion rate of a tool may further be related to a chemical composition of the material tool.

The signal interface sub 204 may include a sensor 206 that may provide various measurements of the fluid mixture in the tool string 120, such as fluid flow rate and fluid viscosity. Additional sensors 232, 234 and 236 also may provide measurements of various other parameters of the fluid, such as proppant type, proppant size, proppant density, etc. In alternate embodiments, additional sensors that may be used to provide additional pumping parameters. The measured values of the pumping parameters may be sent to a control unit 210. The control unit 210 may use these pumping parameters to determine a life expectancy and/or wear rate of the tool string 120 and/or various downhole tools The control unit 210 includes a processor 212 and a memory storage device 216, which may be a non-transitory memory storage device, such as a solid-state memory, tape or hard disc. The memory storage device 216 stores therein one or more programs 214 that are accessible to the processor 212 for determining various values, such as wear rate, erosion rate, life expectancy of a tool, etc. as well as to operate the various surface equipment 102. The control unit 210 may store these values to the memory storage device 216 or send these values to a display 218.

Figure 3:
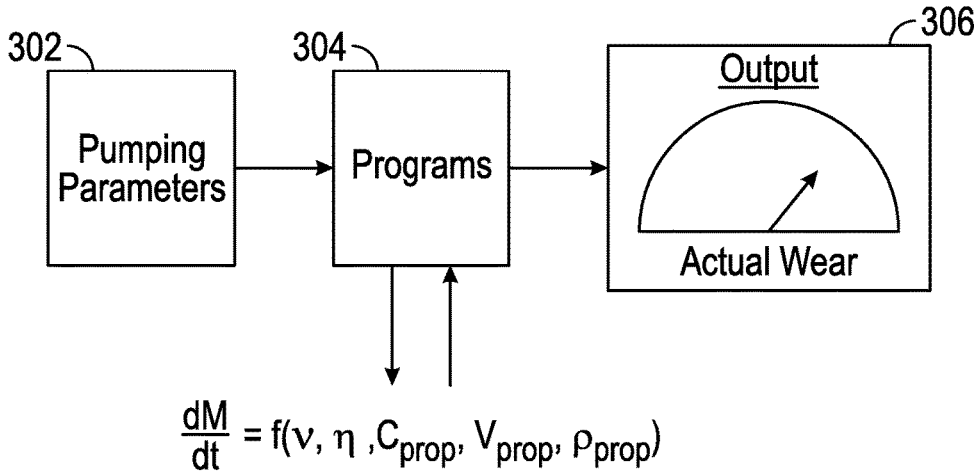
FIG. 3 schematically illustrates a process flow for estimating life expectancy of a tool of the completion system of FIG. 1 during a pumping operation.

FIG. 3 schematically illustrates a process flow for estimating life expectancy of a tool of the completion system 100 during a pumping operation in one embodiment of the present disclosure. The pumping parameters 302 may be obtained from the various sensors (e.g., 206, 232, 234, 236 of FIG. 2) or other sensors. Additional information may be provided from databases or by operator input. In one embodiment, the pumping parameters 302 are obtained while the pumping operation is in progress, so that in-situ measurements of fluid velocity, fluid viscosity, proppant concentration, volume, etc. may be obtained. The pumping parameters 302 are provided during the pumping operation to programs 304 which includes various algorithms that determine a rate of wear of a tool for selected values of the pumping data 302. For example, a wear rate dM/dt may be a function of several variables:

$$\frac{dM}{dt} = f(v, \eta, C_{prop}, V_{prop}, \rho_{prop}) \quad \text{Eq. (1)}$$

where $v$ is a fluid flow rate, $\eta$ is a fluid viscosity, $C_{prop}$ is a concentration of proppant, $V_{prop}$ is a volume of the proppant and $\rho_{prop}$ is a density of the proppant. Other pumping parameters may also be used to determine wear rate. In addition, any suitable equation or algorithm may be used to determine the wear rate. In a particular example, the wear rate may be determined by:

$$\frac{dM}{dt} = \sum_{p=1}^{N} \frac{\dot{m}_p C(dp) f(\alpha) v^{b(v)}}{A} \quad \text{Eq. (2)}$$

where $\dot{m}_p$ is a mass flow rate of a $p^{th}$ particle, C(dp) is a physical factor or constant value, $f(\alpha)$ is an angle of impact of the fluid mixture at the downhole tool and $v$ is a velocity of the fluid mixture ($b(v)$ is a velocity-dependent scalar quantity). Additionally, N is a number of particles in the fluid mixture and p is an index for counting the particles of the fluid mixture. The programs 304 provide the estimate of life expectancy and/or wear rate to a display 306. In various embodiments, the estimate may be shown at display 306 in a manner suitable for quick and comprehensive understanding by an operator.

Once a wear rate of the downhole tool is determined, a life expectancy of the tool may be determined. The life expectancy and/or the wear rate may be used, either by an operator or by the processor (212, FIG. 2) to determine course of action. In one embodiment, one or more of the pumping parameters may be altered so as to either increase or decrease an expected life expectancy of the tool. Alternatively, the processor (212, FIG. 2) may recommend a new value for a pumping parameter to an operator, wherein the new value has an effect on a life expectancy and/or wear rate of the downhole tool. The operator may then review the recommended new value and manually change the pumping parameter to its new value. For example, the fluid flow rate may be either increased or decreased during the pumping operation to achieve a selected life expectancy. Alternatively, the processor (212, FIG. 2) or operator may compare an accumulated time-of-use of the downhole tool to the estimated life expectancy or to a criterion based on the estimated life expectancy (e.g., a selected margin of safety with respect to the estimated life expectancy). When the accumulated time-of use of the downhole tool matches or exceeds the estimate life expectancy or its related criterion, the processor (212, FIG. 2) or operator may stop or reduce use of the downhole tool. Additionally, maintenance schedules for the downhole tool may be set up with respect to the estimated life expectancy.

Figure 4:
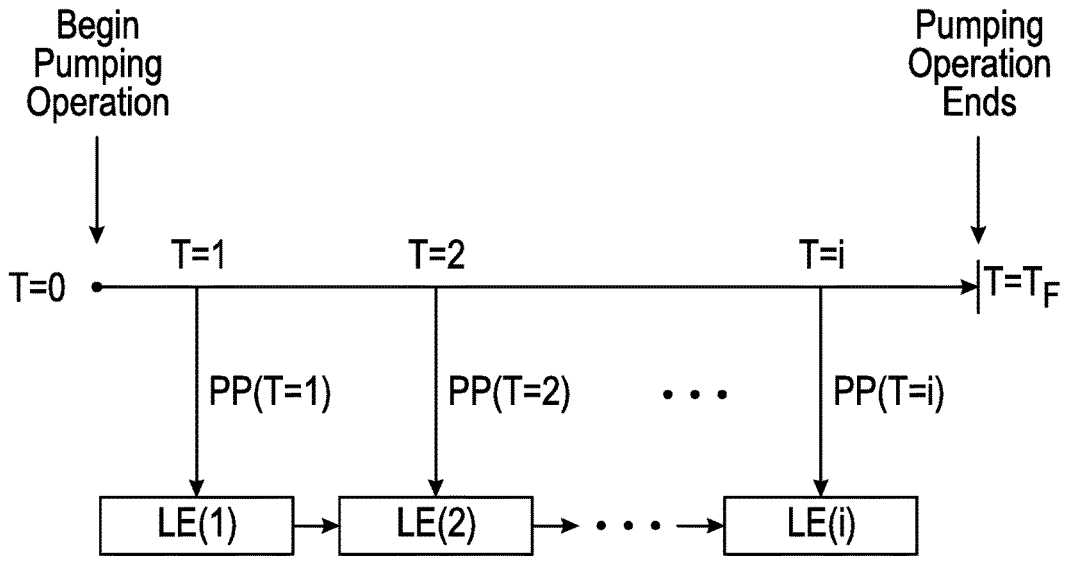
FIG. 4 shows a timeline illustrating multiple calculations of the life expectancy during a pumping process.

In various embodiments, the life expectancy and/or wear rate may be estimated several times during the pumping operation. The estimated wear rate or estimated life expectancy calculated at a first time during the pumping operation may be used in calculations of life expectancy and wear rate performed at a second time that comes after the first time. FIG. 4 shows a timeline illustrating multiple calculations of the life expectancy during a pumping process. The pumping operation starts at time T=0. At time (T=1) one or more pumping parameters PP(T=1) are measured and used to determine the life expectancy (LE1) and/or wear rate of the tool. The pumping parameters may be altered at this time based on the first estimate of life expectancy (LE1). At time (T=2), the one or more pumping parameters PP(T=2) are measured. These measurements PP(T=2) and the previously-determined life expectancy (LE1) may be used to calculate a second estimate of life expectancy (LE2). This iterative process may continue as illustrated in FIG. 4 until a time ($T=T_F$) at which the pumping process ends.

Figure 5:
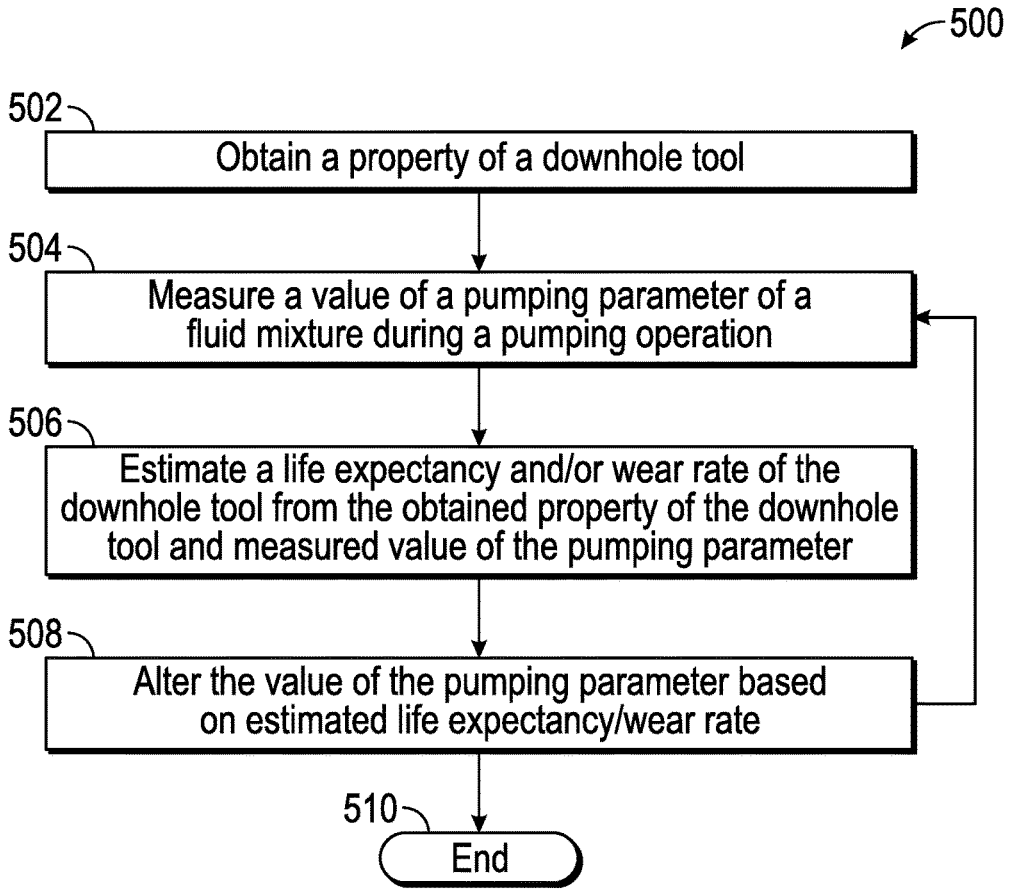
FIG. 5 shows a flowchart illustrating an exemplary method for estimating a life expectancy of a tool used in a pumping operation in one embodiment.

FIG. 5 shows a flowchart 500 illustrating an exemplary method for estimating a life expectancy of a tool used in a pumping operation in one embodiment. In Box 502, one or more properties of the downhole tool may be obtained (e.g., chemical composition of material of the tool, surface area, simulated flow fields, physical wear data, etc.). In Box 504, sensors (e.g., sensors 206, 232, 234, 236 of FIG. 2) measure a value of a pumping parameter of a fluid mixture. These values are measured during a pumping operation. In Box 506, an estimate is calculated for a life expectancy and/or wear rate of the downhole tool using the obtained property of the downhole tool and the measured value of the pumping parameter. In Box 508, a pumping parameter is altered based on the estimate for the life expectancy and/or wear rate. The alteration of the pumping parameter also occurs during the pumping operation. From Box 508, the method may return to Box 504 in order to perform subsequent calculations of life expectancy and/or wear rate. Alternately, the method may proceed from Box 508 to end at Box 510.

Therefore in one aspect, the present disclosure provides a method of estimating a life expectancy of a tool used in a pumping operation, the method including: obtaining a property of the tool; selecting a pumping parameter of the downhole operation, wherein the pumping parameter is related to erosion of the tool; measuring a value of the pumping parameter during the pumping operation; and estimating, during the pumping operation, the life expectancy of the tool using the obtained property of the downhole tool and the measured value of the pumping parameter. The tool may include, in various embodiments, a cross-over tool, a sand control tool, a gravel pack completion tool, a fracking tool, a pumping tool, etc. The pumping parameter may includes a fluid flow rate, a fluid viscosity, a proppant type, a proppant size, a proppant density, etc. Use of the tool may be suspended when an accumulated time-of-use of the tool substantially matches a criterion related to the estimated life expectancy of the tool. The pumping parameter may be altered via a control unit. Alternatively, a new set of pumping parameter may be recommended to an operator. In one embodiment, the life expectancy of the tool may be calculated using or based on a previously-estimated life expectancy.

In another aspect, the present disclosure provides a system for estimating a life expectancy of a tool in a pumping operation, the system including: a sensor configured to measure, during the pumping operation, a value of a pumping parameter related to erosion of the tool; and a processor configured to: obtain a property of the tool, and estimate, during the pumping operation, a life expectancy of the tool using the obtained property the tool and the measured value of the pumping parameter. In various embodiments, the tool may include a cross-over tool, a sand control tool, a gravel pack completion tool, a fracking tool, a pumping tool, etc. The pumping parameter may include a fluid flow rate, a fluid viscosity, a proppant type, a proppant size, a proppant density, etc. The processor may be further configured to suspend use of the tool when an accumulated time-of-use of the tool substantially matches a criterion related to the estimated life-expectancy of the tool. Also, the processor may alter the pumping parameter during the pumping process in order to affect the life expectancy of the tool or recommend a new value of the pumping parameter to an operator. In one embodiment, the processor estimates the life expectancy of the tool using a previously-estimated life expectancy.

In yet another embodiment, the present disclosure provides a non-transitory computer-readable medium includes a set of instructions stored thereon that when accessed by a processor enable the processor to perform a method of estimating a life expectancy of a tool used in a pumping operation, the method including: obtaining a property of the tool; selecting a pumping parameter of the pumping operation related to erosion of the tool; measuring a value of the pumping parameter during the pumping operation; and estimating, during the pumping operation, the life expectancy of the tool using the obtained property the tool and the measured value of the pumping parameter. In various embodiments, the tool may include a cross-over tool, a sand control tool, a gravel pack completion tool, a fracking tool, a pumping tool, etc. The pumping parameter may include a fluid flow rate, a fluid viscosity, a proppant type, a proppant size, a proppant density, etc. The method may include suspending use of the tool when an accumulated time-of-use of the tool substantially matches a criterion related to the estimated life-expectancy of the tool. The method may further include at least one of: (i) altering the pumping parameter during the pumping process in order to affect the life expectancy of the tool; and (ii) recommending a new value of the pumping parameter to an operator. Additionally, the method may include estimating the life expectancy of the tool using a previously-estimated life expectancy.

While the disclosure has been described with reference to an exemplary embodiment or embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the claims.

What is claimed is:

1. A method of estimating a life expectancy of a tool used in a pumping operation, comprising:

obtaining a property of the tool including a chemical composition of the tool;

selecting a pumping parameter of a fluid flowing in the tool during the pumping operation, wherein the pumping parameter of the fluid is related to erosion of the tool;

measuring a value of the pumping parameter of the fluid during the pumping operation; and estimating, during the pumping operation, a mass wear rate of the tool using the obtained property of the downhole tool including the chemical composition of the tool and the measured value of the pumping parameter of the fluid.

2. The method of claim 1, wherein the tool further comprises at least one selected from the group consisting of: (i) a cross-over tool; (ii) a sand control tool; (iii) a gravel pack completion tool; (iv) a fracking tool; and (v) a pumping tool.

3. The method of claim 1, wherein the pumping parameter of the fluid includes at least one of: (i) a fluid flow rate; (ii) a fluid viscosity; (iii) proppant type; (iv) proppant size; (v) proppant density.

4. The method of claim 1, further comprising estimating a life-expectancy of the tool from the wear rate and suspending use of the tool when an accumulated time-of-use of the tool substantially matches a criterion related to the estimated life-expectancy of the tool.

5. The method of claim 1, further comprising performing at least one of: (i) altering the pumping parameter of the fluid during the pumping operation to affect the wear rate of the tool; and (ii) recommending a new value of the pumping parameter of the fluid to an operator.

6. The method of claim 1, further comprising estimating the wear rate of the tool using a previously-estimated wear rate.

7. A system for estimating a life expectancy of a tool in a pumping operation, comprising:

a sensor configured to measure, during the pumping operation, a value of a pumping parameter of a fluid, wherein the pumping parameter of the fluid is related to erosion of the tool; and a processor configured to:

obtain a property of the tool including a chemical composition of the tool, receive the value of the pumping parameter of the fluid from the sensor; and estimate, during the pumping operation, a mass wear rate of the tool using the obtained property of the tool including the chemical composition of the tool and the measured value of the pumping parameter of the fluid.

8. The system of claim 7, wherein the tool further comprises at least one selected from the group consisting of: (i) a cross-over tool; (ii) a sand control tool; (iii) a gravel pack completion tool; (iv) a fracking tool; and (v) a pumping tool.

9. The system of claim 7, wherein the pumping parameter of the fluid includes at least one of: (i) a fluid flow rate; (ii) a fluid viscosity; (iii) proppant type; (iv) proppant size; (v) proppant density.

10. The system of claim 7, wherein the processor is further configured to estimate a life expectancy of the tool from the wear rate and suspend use of the tool when an accumulated time-of-use of the tool substantially matches a criterion related to the estimated life-expectancy of the tool.

11. The system of claim 7, wherein the processor is further configured to perform at least one of: (i) altering the pumping parameter of the fluid during the pumping process in order to affect the wear rate of the tool; and (ii) recommending a new value of the pumping parameter of the fluid to an operator.

12. The system of claim 7, wherein the processor is further configured to estimate the wear rate of the tool using a previously-estimated wear rate.

13. A non-transitory computer-readable medium includes a set of instructions stored thereon that when accessed by a processor enable the processor to perform a method of estimating a wear rate of a tool used in a pumping operation, the method comprising:

obtaining a property of the tool including a chemical composition of the tool;

selecting a pumping parameter of a fluid flowing in the tool during the pumping operation, wherein the pumping parameter is related to erosion of the tool;

measuring a value of the pumping parameter during the pumping operation; and estimating, during the pumping operation, a mass wear rate of the tool using the obtained property of the tool including the chemical composition of the to and the measured value of the pumping parameter of the fluid.

14. The non-transitory computer-readable medium of claim 13, wherein the tool further comprises at least one selected from the group consisting of: (i) a cross-over tool; (ii) a sand control tool; (iii) a gravel pack completion tool; (iv) a fracking tool; and (v) a pumping tool.

15. The non-transitory computer-readable medium of claim 13, wherein the pumping parameter of the fluid further includes at least one of: (i) a fluid flow rate; (ii) a fluid viscosity; (iii) proppant type; (iv) proppant size; (v) proppant density.

16. The non-transitory computer-readable medium of claim 13, wherein the method further comprises estimating a life expectancy of the tool from the wear rate and suspending use of the tool when an accumulated time-of-use of the tool substantially matches a criterion related to the estimated life-expectancy of the tool.

17. The non-transitory computer-readable medium of claim 13, wherein the method further comprises at least one of: (i) altering the pumping parameter of the fluid during the pumping process in order to affect the wear rate of the tool; and (ii) recommending a new value of the pumping parameter of the tool to an operator.

18. The non-transitory computer-readable medium of claim 13, wherein the method further comprises estimating the wear rate of the tool using a previously-estimated wear rate.

* * * * *